US008839616B1

(12) United States Patent
Perez

(10) Patent No.: US 8,839,616 B1
(45) Date of Patent: Sep. 23, 2014

(54) WATER TOWER COMPLEX

(76) Inventor: Jose A. Perez, Camuy, PR (US)

( * ) Notice: Subject to any disclaimer, the term of this patent is extended or adjusted under 35 U.S.C. 154(b) by 826 days.

(21) Appl. No.: 13/041,492

(22) Filed: Mar. 7, 2011

Related U.S. Application Data

(60) Provisional application No. 61/312,641, filed on Mar. 10, 2010.

(51) Int. Cl.
*F03C 1/00* (2006.01)

(52) U.S. Cl.
USPC ..... 60/398; 60/495; 60/639

(58) Field of Classification Search
USPC ..... 60/398, 495, 496, 497, 639
See application file for complete search history.

(56) References Cited

U.S. PATENT DOCUMENTS

| | | | | |
|---|---|---|---|---|
| 1,029,030 | A * | 6/1912 | Sander | 60/398 |
| 3,939,356 | A * | 2/1976 | Loane | 60/398 |
| 4,583,368 | A * | 4/1986 | Neuenschwander | 60/639 |
| 6,647,717 | B2 * | 11/2003 | Zaslavsky et al. | 60/398 |
| 6,861,766 | B2 * | 3/2005 | Rembert | 60/398 |
| 6,945,042 | B1 * | 9/2005 | Walckner | 60/495 |
| 7,239,035 | B2 * | 7/2007 | Garces et al. | 60/398 |
| 7,836,689 | B2 * | 11/2010 | Sieber | 60/398 |
| 8,118,569 | B2 * | 2/2012 | Yu | 60/495 |
| 8,333,070 | B2 * | 12/2012 | Huang et al. | 60/495 |

* cited by examiner

*Primary Examiner* — Thomas E Lazo
(74) *Attorney, Agent, or Firm* — Luis Figarella

(57) ABSTRACT

An integrated wind and hydro power generation system includes at least one wind turbine generator device configured to generate output power from a common cavity being occupied by water and air. The hydro generator device is powered by water flow, while the wind generator is primarily powered by the vacuum occurring with the water's exit from the cavity.

1 Claim, 7 Drawing Sheets

WATER TOWER COMPLEX

CROSS-REFERENCE TO RELATED APPLICATIONS

This application claims priority to U.S. provisional patent application Ser. No. 61/312,641 titled "Water Tower Complex" filed on Mar. 10, 2010 the disclosure of which is herein incorporated by reference in its entirety.

PATENTS CITED

The following documents and references are incorporated by reference in their entirety, Garces et al (U.S. Pat. No. 7,239,035), Loane (U.S. Pat. No. 3,939,356), Zaslaysky et al (U.S. Pat. No. 6,647,717).

FIELD OF THE INVENTION

The present invention generally relates to the generation of energy, in particular to the generation of energy in a highly efficient manner by combining hydroelectric and wind generation systems.

DESCRIPTION OF THE RELATED ART

Hydroelectric or Hydro power stations are well known, they utilize the kinetic energy released by water as it comes down from a height, to move a turbine connected to a generator. Similarly, wind is a recent fast growing renewable energy resources. Turbines, which use the kinetic energy of wind to generate mechanical energy, convert the mechanical energy to electricity. As the wind causes the blades to rotate, the shaft in the turbine spins. The mechanical energy generated may be used to power certain tasks, such as pumping water for example, or the mechanical energy may be converted to electricity. When connected to a generator, the spinning of the shaft drives a generator, which in turn produces electricity.

The intermittent nature and variable speed of wind are one of the major drawbacks of wind generation systems. Existing solutions to the intermittency problem of wind power generation devices have traditionally either been cost prohibitive or have low energy efficiency. One way to mitigate intermittency and increase system availability is to use wind generation in parallel with other generating sources, which can be complimentary to the wind. It has been observed that in certain locations of the world, wind and hydro show complimentary patterns of availability, both on a daily basis and a seasonal basis.

Pumped hydroelectric storage is one of the more economically viable energy storage methods. At times of low electrical demand, excess electrical capacity is used to pump water into an upper reservoir. When there is higher demand, water is released back into the lower reservoir through a turbine, thereby generating hydroelectricity. Reversible turbine/generator assemblies can act as both pump and turbine. However, as a result of evaporation losses from the exposed water surface and mechanical efficiency losses during conversion, about 60% to about 85% of the electrical energy used to pump the water into the elevated reservoir may be regained from this process. This compares relatively favorably with respect to other energy storage devices such as some types of batteries and hydrogen fuel cells.

Notwithstanding the respective advantages of wind generated power systems and hydroelectric storage systems, the challenges of integrating wind with pumped hydroelectric storage have not been adequately addressed.

Accordingly, it would be desirable to implement an integrated, wind and hydro system that would provide a cost effective solution by maximizing the aspects of water and air energy generation.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention maximizes the energy obtained from a stored liquid column by generating electricity from its potential to kinetic energy conversion, as well as by maximizing all other energy conversions.

Other features and advantages of the present invention will become apparent upon examining the following detailed description of an embodiment thereof, taken in conjunction with the attached drawings.

DETAILED DESCRIPTION OF THE PREFERRED EMBODIMENT

To provide an overall understanding of the invention, certain illustrative embodiments will now be described, including apparatus and methods for displaying images. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope hereof.

Figure 1:
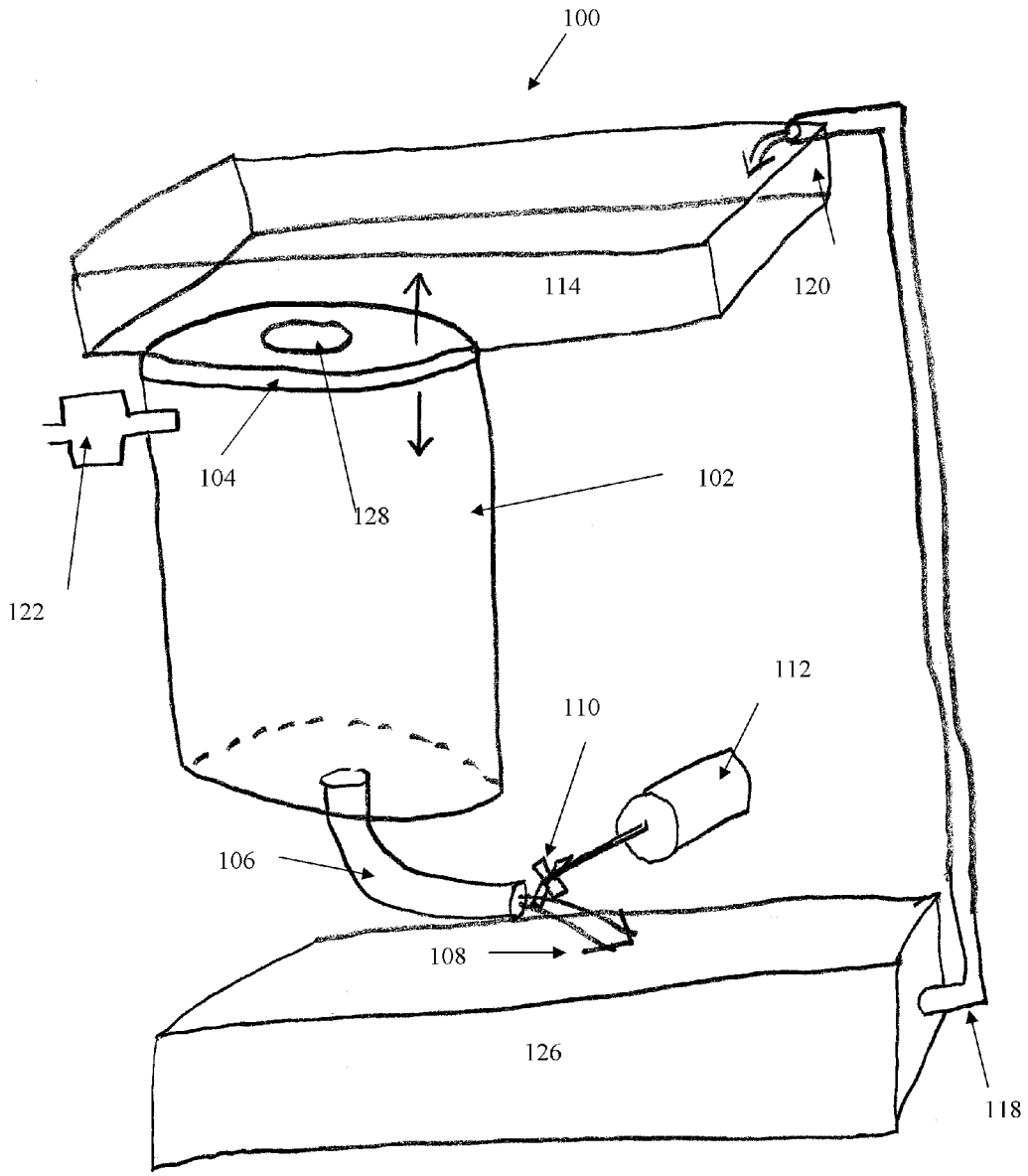
FIG. 1 shows an illustration of an exemplary embodiment of the victory pipe.

In one embodiment, the system consists of the generation of energy through the fall of a liquid (in one embodiment water, but any fluid may be used) on a tower or vertical tsunami through a vertical cylinder or victory pipe, in combination with the use of air to maximize the energy equation. One illustrative embodiment of such a cylinder 100 is shown on FIG. 1. The vertical cylinder 102 is the core of the system. In one embodiment, a fluid reservoir 114 is placed above one or more such cylinders 102. In one embodiment, a moveable cover 104, equipped with a controllable valve 128 is placed within the cylinder.

The valve 128 may be comprised of any mechanical means capable of preventing any fluids (including air) from travelling from one side of the cover 104 to the other, such as those comprised by butterfly, gate, stop, globe and ball valves. It may be mechanically, electrically, hydraulically or pneumatically actuated, in synchronization with the movement of the cover 104 up/down the cylinder 102.

The cover 104 is itself designed to be strong enough to prevent the liquid from flowing past it into the bottom of the cylinder 102, as well as air into the reservoir 114, unless it is accomplished through the cover valve 128. The cover is also designed to be lighter than the fluid. In one embodiment, this is done by building air cavities within its structure, although alternate embodiments may accomplish this by using a lighter material in overall volume to the liquid displaced by its volume.

The buoyancy of the cover 104 will cause it to move up the cylinder 102 when it is filled with liquid and down it when the volume is filled with air or gas, in response to the weight of the fluid above it. This motion is similar to that of a piston up/down the cylinder. Mechanical means will be provided to ensure this energy applied to the cover (during both the down and up stroke) is captured and used for energy generation. In one embodiment, this is done through cables connected to the cover. In an alternate embodiment, the cover down/up motion turns a belt or screw.

In one embodiment, the energy captured from the cover 104 movement is used to help pump the fluid back from the sump 126 to the reservoir 114, whereas in an alternate embodiment this energy is used to assist in moving the electrical generation 112 dynamos.

The beginning of the energy generation cycle begins with the cover 104 at the top position of the cylinder, and the cylinder filled with gas or air. The air input valve 122 and cover valve 128 are both closed, and the cover 104 is allowed to be pushed down by the weight of the water above it. This energy is captured by the cover 104 mechanical energy capture means. Note that the downward movement of the cover 104 proceeds to compress the gas within the cylinder 102, pushing it out 108 through the exit pipe 106 moving a turbine 110 which in turn moves an electrical generator dynamo 112. When the cover 104 reaches bottom, the valve 128 is opened. This allows the fluid to flow through the exit pipe 106 to the same turbine 110 dynamo 112 combinations. The fluid comes out 108 draining into a sump 126, from which it will be recycled through pipes 118 back 120 to the reservoir 114.

In one embodiment, the pipe is 106 is a cone tapering from the diameter of the cylinder 102 down to that of the exit 108 into the turbine 110. In an alternate embodiment, the pipe 106 is of uniform diameter, coming off an exit at the bottom of the cylinder 102.

In one embodiment, the exit 108 goes directly into the turbine 110. In another, there is a valve at the exit point 108 comprised of any of the valves normally used to stop the flow of water, or from the group proposed for use on the cover valve 128. Similarly, the turbine 110 area may have one or more turbines in sequence.

Upon opening of the cover valve 128, the cover will begin ascending the cylinder 102 to the top. Upon reaching the top, the cover valve 128 is closed, and the input valve 122 opened. This causes the fluid within the cylinder 102 to continue draining until the cylinder 102 drains of fluid. At this time the input valve 122 is closed, and the procedure repeats.

In one embodiment, the input valve 122 is connected to a pressurized source of air, accelerating the flow of the fluid down the cylinder. In an alternate embodiment, the input valve is connected to the outside atmosphere.

Figure 2:
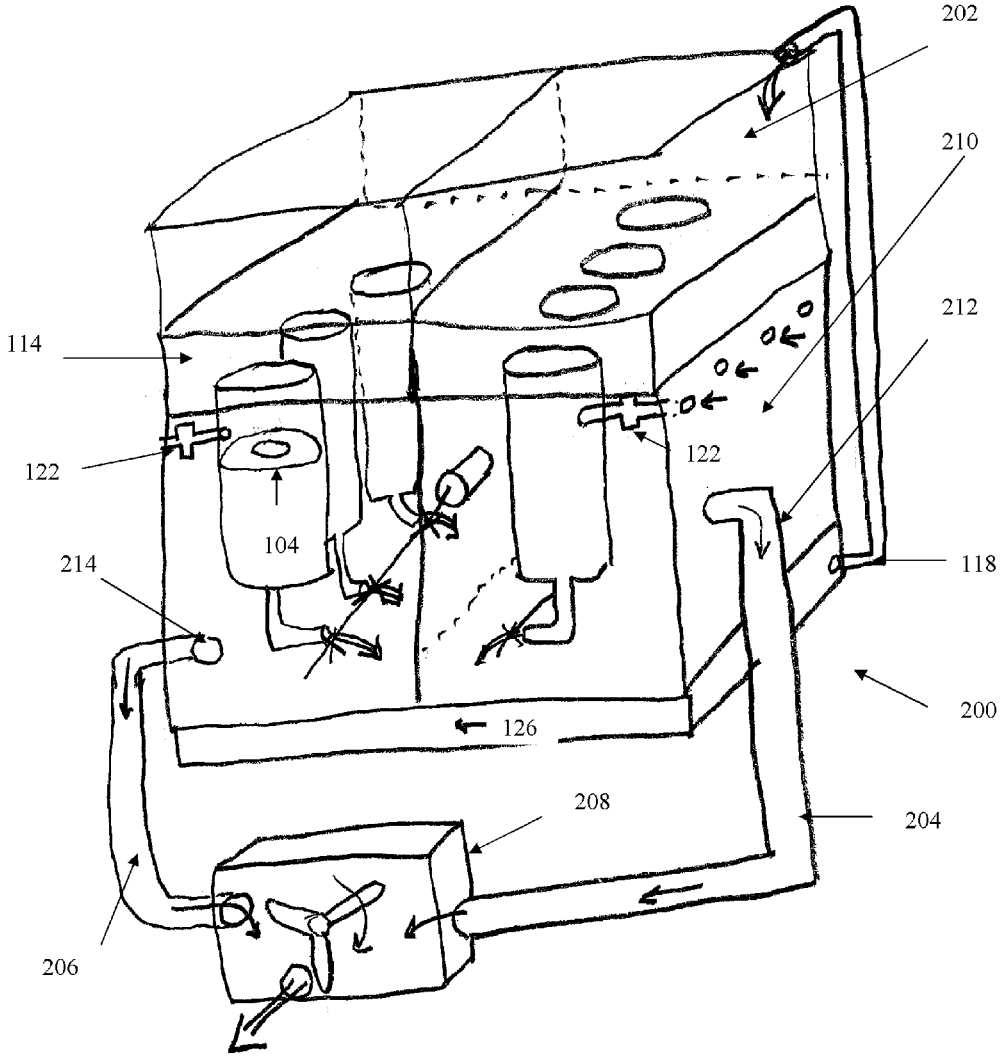
FIG. 2 shows an illustration of an exemplary embodiment of the water tower, containing a number of victory pipes and other components.

FIG. 2 illustrates an exemplary embodiment of the invention showing a series of pipes 200, as well as other parts of the system. In one embodiment, two or more banks (each containing one or more cylinders) are used. This allows for a common fluid reservoir 114, which may be separated in alternate embodiments. In one embodiment, the fluid reservoir 114 is maintained within a sealed fixed volume container 202, which is not open to the atmosphere. In an alternate embodiment, the container is open to the atmosphere via valves that are similar in operation to the cylinder input valves 122.

The cylinder operation may be coordinated (similar to the firing of an engine), or left to its own efficiencies. The input of air via the input valves 122 as the water is displaced, creates a situation wherein the volume 210 housing cylinders, receives an amount of air. In one embodiment, the exit of the gas from the housing 210 is controlled by an exit valve (212, 214), which would allow the gas to flow via an exit pipe (204, 206) to a windmill/air turbine/dynamo combination 208. In an alternate embodiment, this air pressure increase would be used to facilitate the flow of fluid from the sump 126, back up to the reservoir.

Figure 3:
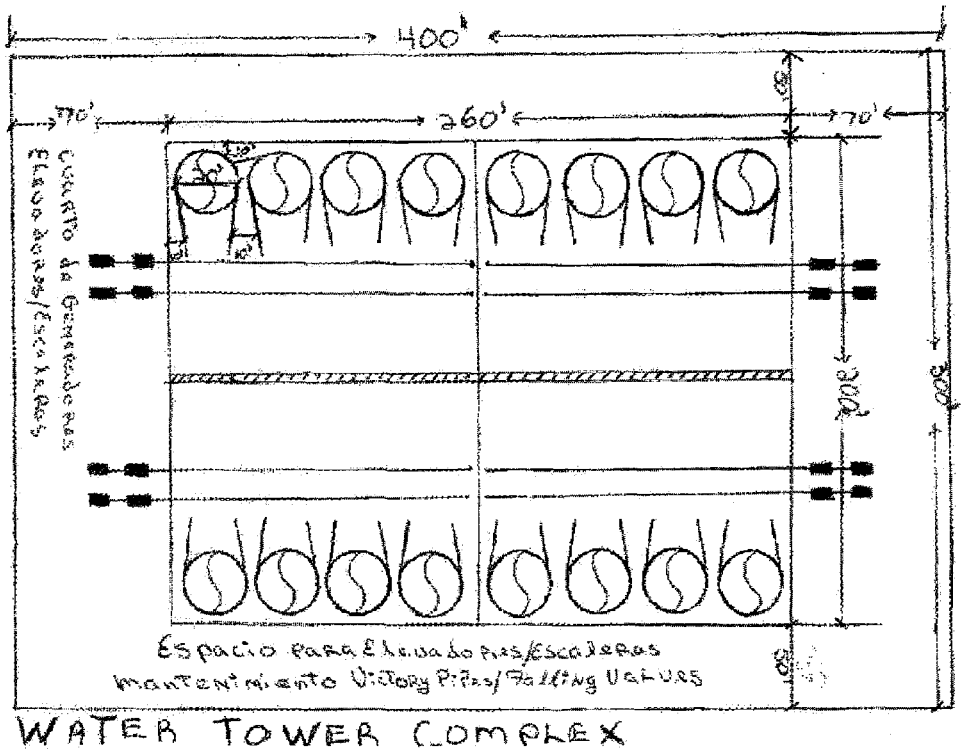
FIG. 3 shows an illustration of an exemplary embodiment of the water tower complex.
Figure 4:
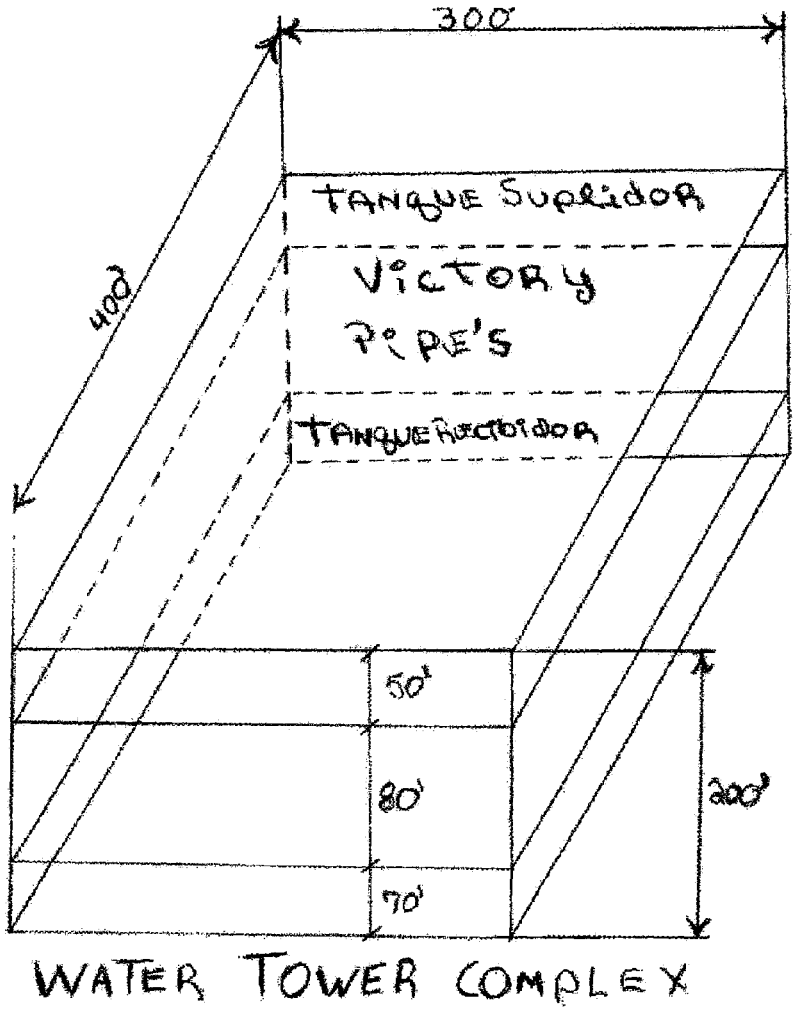
FIG. 4 shows an illustration of the top view of the exemplary embodiment of the complex.
Figure 5:
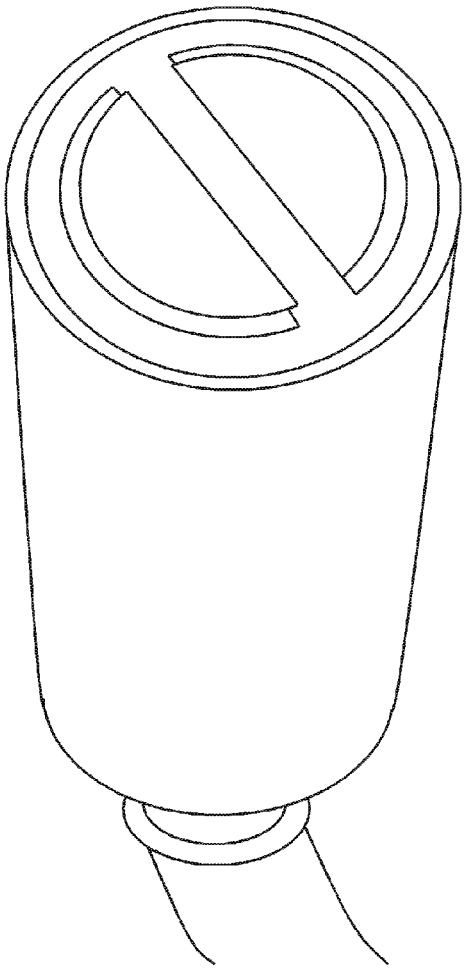
FIGS. 5, 6 and 7 show illustrations of various parts of the system according to one exemplary embodiment of the complex.
Figure 6:
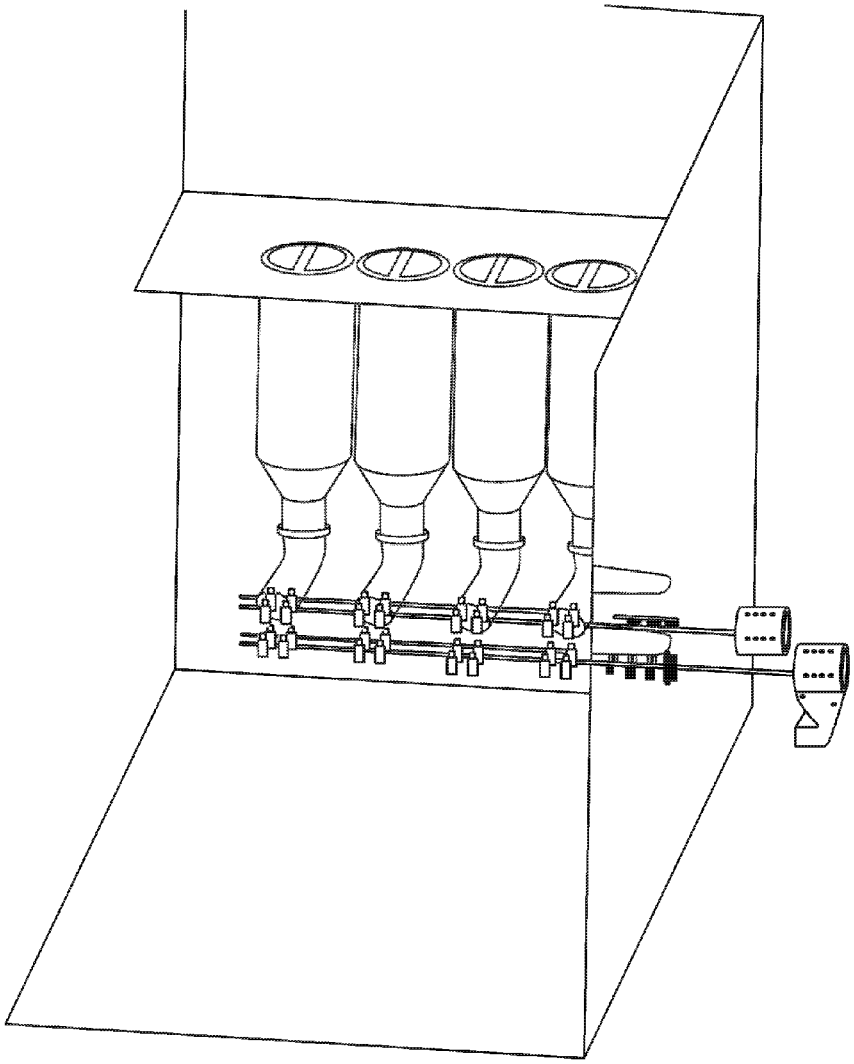
Figure 7:
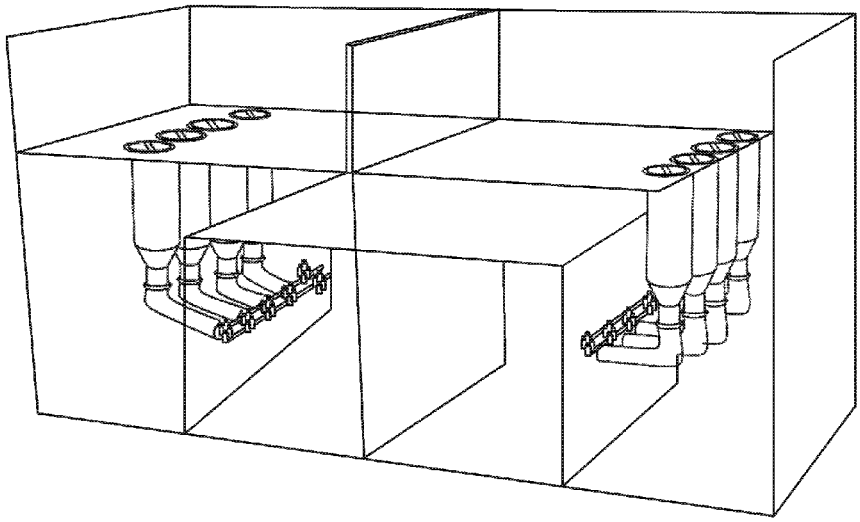

FIG. 3 illustrates some of the dimensions in one embodiment of the invention. FIG. 4 illustrates how in one embodiment, four banks of four cylinders each could be combined.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. An apparatus comprising;

a structure containing a number of chambers;

a fluid reservoir within one of said chambers;

one or more cylinders connected to said fluid reservoir, each said cylinder containing a cover with a valve, and one or more pipes each with one or more valves, said pipes located near the top of said cylinder;

an exit pipe near the bottom of said cylinder, said exit pipe connected with a turbine; and a fluid sump connected to the fluid reservoir.

* * * * *